US011713752B2

(12) United States Patent
Kim et al.

(10) Patent No.: US 11,713,752 B2
(45) Date of Patent: Aug. 1, 2023

(54) SCROLL COMPRESSOR OF LOWER COMPRESSION TYPE ENABLING ACTIVE OIL SUPPLY

(71) Applicant: LG Electronics Inc., Seoul (KR)

(72) Inventors: Taekyoung Kim, Seoul (KR); Kyungho Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 269 days.

(21) Appl. No.: 17/075,198

(22) Filed: Oct. 20, 2020

(65) Prior Publication Data

US 2021/0131412 A1 May 6, 2021

(30) Foreign Application Priority Data

Nov. 5, 2019 (KR) ..... 10-2019-0140320

(51) Int. Cl.
*F04B 27/10* (2006.01)
*F04C 29/02* (2006.01)
(Continued)

(52) U.S. Cl.
CPC ..... *F04B 27/109* (2013.01); *F04B 39/0253* (2013.01); *F04C 29/025* (2013.01); *F04C 29/065* (2013.01)

(58) Field of Classification Search
None
See application file for complete search history.

(56) References Cited

U.S. PATENT DOCUMENTS 11,293,442 B2 * 4/2022 Jeon ..... F04C 29/0035
2015/0030487 A1 1/2015 Toyama et al.
(Continued)

FOREIGN PATENT DOCUMENTS

EP 1956244 A2 * 8/2008 ..... F04C 18/0215
EP 3239527 11/2017
(Continued)

OTHER PUBLICATIONS

Korean Office Action in Korean Application No. 10-2019-0140320, dated Jan. 5, 2021, 10 pages (with English translation).
(Continued)

*Primary Examiner* — Nathan C Zollinger
*Assistant Examiner* — Geoffrey S Lee
(74) *Attorney, Agent, or Firm* — Fish & Richardson P.C.

(57) ABSTRACT

A compressor includes a driving motor, a centrifugation space, a discharge pipe, a rotary shaft, a compression portion, a pump assembly, and an oil pickup. The centrifugation space is defined inside a case by a downstream side of the driving motor and the case, and enables centrifugation of a compressed refrigerant and a lubricant oil. The discharge pipe can discharge the refrigerant from the centrifugation space outside the case. The rotary shaft is coupled to a rotor of the driving motor and defines an oil supply path. The compression portion is provided at an upstream side of the driving motor and can compress the refrigerant as the rotary shaft rotates. The pump assembly is provided below the rotary shaft and can pump oil as rotated with the rotary shaft. The oil pickup defines an oil supply path between the pump assembly and a low oil space formed inside the case.

15 Claims, 4 Drawing Sheets

(51) Int. Cl.
*F04C 29/06* (2006.01)
*F04B 39/02* (2006.01)

(56) References Cited

U.S. PATENT DOCUMENTS

| | | | | |
|---|---|---|---|---|
| 2017/0306964 | A1* | 10/2017 | Kim | F04C 29/026 |
| 2019/0195224 | A1* | 6/2019 | Matsui | F04C 29/023 |
| 2019/0309753 | A1* | 10/2019 | Jeon | F04C 29/0035 |
| 2022/0178371 | A1* | 6/2022 | Lee | F04C 18/0215 |

FOREIGN PATENT DOCUMENTS

| | | | | |
|---|---|---|---|---|
| KR | 1020170122015 | | 11/2017 | |
| KR | 1020190028182 | | 3/2019 | |
| WO | WO-2017158809 | A1 * | 9/2017 | F04B 39/02 |

OTHER PUBLICATIONS

EP Extended European Search Report in European Appln. No. 20202008.7. dated Mar. 31, 2021, 8 pages.

* cited by examiner

SCROLL COMPRESSOR OF LOWER COMPRESSION TYPE ENABLING ACTIVE OIL SUPPLY

CROSS-REFERENCE TO RELATED APPLICATION

This application claims the benefit of the Korean Patent Application No. 10-2019-0140320 filed on Nov. 5, 2019, the disclosure of which is hereby incorporated by reference as if fully set forth herein.

TECHNICAL FIELD

The present disclosure relates to a compressor, and more particularly, to a compressor that effectively and actively supply oil for lubrication of a compression portion configured to compress a refrigerant.

BACKGROUND

A compressor can be used in, for example, a refrigerator or an air conditioner, to perform a refrigerant compression type cooling cycle (hereinafter, referred to as a cooling cycle).

A compressor can include a reciprocating compressor and a rotary compressor depending on a method of compressing a refrigerant. A rotary compressor can include a scroll compressor.

A scroll compressor can include an upper compression type and a lower compression type depending on positions of a driving motor and a compression portion. The upper compression type of a scroll compressor includes a compression portion that is located above a driving motor. The lower compression type of a scroll compressor includes a compression portion that is located below a driving motor.

That is, a compressor can be referred to as different types depending on relative positions of a driving motor and a compression portion. For example, the compressor can be disposed horizontally rather than vertically. Therefore, the compressor can be referred to as a more generalized term depending on the relative positions of the driving motor and the compression portion. In accordance with a flow direction of a refrigerant inside the compressor and the position of the driving motor, a compressor can be referred to as an upstream compressor where a refrigerant is compressed at an upstream of the driving motor and discharged from a downstream of the driving motor. A compressor can be referred to as a downstream compressor where a refrigerant is compressed at the downstream of the driving motor and discharged from the downstream of the driving motor.

The compressor can include a bearing portion for rotatably supporting a rotary shaft and a compression portion for compressing a refrigerant. Mechanical friction can occur in the bearing portion and the compression portion. An oil can be supplied such that such friction is reduced and the rotary shaft and the compression portion are actively driven. In some instances, active and effective oil supply can continuously be required to reduce the friction and drive the rotary shaft and the compression portion.

In general, an oil can be supplied based on a pressure difference between a high pressure and a low pressure. For example, a pressure difference between a lower low oil space which is a high pressure space in a case and a low pressure space of a compression chamber where a refrigerant is compressed is used. Accordingly, an oil path can be defined between the lower low oil space and the low pressure space of the compression chamber, due to the pressure difference between the lower low oil space and the low pressure space of the compression chamber.

However, where the pressure difference is used for supplying an oil, it can be difficult to continuously maintain effective and active oil supply in a driving area (e.g., a low pressure ratio driving area) that has no significant pressure difference. This can reduce an effective driving area of a compressor, which can extend from a low speed to a high speed. This is because that low speed driving can be limited due to insufficient oil supply. Therefore, a compressor that can provide a wide driving area and enable effective and active oil supply is required.

SUMMARY

The present disclosure relates to a compressor that address the above-mentioned problems.

Some implementations of the present disclosure provide a compressor that solves problems of scroll compressors of the related art.

Some implementations of the present disclosure provide a compressor that enables effective and active oil supply even in a low pressure ratio driving area that does not provide a sufficient pressure difference.

Some implementations of the present disclosure provide a compressor that has a wide driving area through an oil supply based on a pressure difference together with an oil supply using a pump. For example, some implementations of the present disclosure provide a compressor that includes a pump without substantial modifications to components for an oil supply based on a pressure difference.

Some implementations of the present disclosure provide a compressor that includes a pump assembly for oil supply that exactly match a center of the compressor and is fixed at the center.

Additional advantages, objects, and features of the present disclosure will be set forth in the description that follows and will also become apparent to those having ordinary skill in the art based on the following description or the practice of the present disclosure. Other objectives and advantages of the present disclosure can be realized and attained by the structure particularly pointed out in the written description and claims hereof as well as the appended drawings.

To achieve these objects and other advantages and in accordance with the purpose of the present disclosure, as embodied and broadly described herein, particular implementations of the present disclosure provide a compressor that includes a case, a driving motor, a centrifugation space, a discharge pipe, a rotary shaft, a compression portion, a pump assembly, and an oil pickup. The case defines an oil space. The driving motor includes a stator disposed in the case and a rotor disposed in the stator. The rotor is configured to rotate in the stator. The centrifugation space is defined in the case by a first side of the driving motor and the case, and is configured to permit centrifugation of a compressed refrigerant and a lubricant oil. The discharge pipe is disposed at the case and configured to discharge the refrigerant from the centrifugation space to an exterior of the case. The rotary shaft is coupled to the rotor and configured to rotate based on rotation of the rotor. The rotary shaft defines a first oil supply path. The compression portion is disposed at a second side of the driving motor that is opposite to the first side of the driving motor, wherein the compression portion is configured to compress the refrigerant based on rotation of the rotary shaft. The pump assembly is configured to rotate with the rotary shaft and pump the oil based on the rotation of the pump assembly. The oil pickup defines a second oil supply path between the pump assembly and the oil space of the case.

In some implementations, the compressor can optionally include one or more of the following features. The compression portion may include a muffler that is configured to receive the compressed refrigerant that is discharged from the compression portion. The compression portion may be configured to guide the compressed refrigerant to the discharge pipe. The compression portion may include a fixed scroll and an orbiting scroll that is configured to orbit with respect to the fixed scroll and compress the refrigerant based on orbiting of the orbiting scroll with respect to the fixed scroll. A shaft support portion of the fixed scroll may be disposed at a center of the fixed scroll and receive the rotary shaft through the shaft support portion of the fixed scroll. The shaft support portion of the fixed scroll may include a first boss that protrudes toward the oil space of the case. A pump holder portion may be defined at a center of the muffler and recessed toward the driving motor. The pump assembly may be disposed in the pump holder portion. A shaft support portion of the pump holder portion may be disposed at a center of the pump holder portion and receive the rotary shaft through the shaft support portion of the pump holder portion. The shaft support portion of the pump holder portion may include a second boss that protrudes toward the driving motor. At least a portion of the first boss may be inserted into the second boss. The first boss and the second boss may be at least partially overlapped with each other. The pump assembly may include an oil pump that is connected to the rotary shaft, and pump housings that receive the oil pump. The pump housings includes an upper housing that is inserted into the pump holder portion of the muffler, and a lower housing that is coupled with the upper housing. The upper housing includes a shaft support portion of the upper housing that receives the rotary shaft through the shaft support portion of the upper housing, and a third boss that protrudes toward the driving motor. At least a portion of the third boss may be inserted into the first boss. The first boss and the third boss may be at least partially overlapped with each other. The lower housing may include an end shaft support portion that receives and supports an end of the rotary shaft. A pumping space may be defined between the shaft support portion of the upper housing and the end shaft support portion of the lower housing and receive the oil pump. The lower housing may include a communication portion that fluidly communicates the pumping space with the oil space. The communication portion may include a pickup arrangement groove that receives the oil pickup. The lower housing may include a plurality of coupling holes that are coupled with the upper housing. The rotary shaft may include a motor coupling portion, a main bearing portion, an eccentric portion, a sub bearing portion, and a pump coupling portion. The motor coupling portion may be coupled with the driving motor. The main bearing portion may extend from the motor coupling portion. The eccentric portion may extend from the main bearing portion and is coupled with the orbiting scroll. The sub bearing portion may extend from the eccentric portion. The pump coupling portion may extend from the sub bearing portion and is coupled with the pump assembly. The motor coupling portion, the main bearing portion, the sub bearing portion and the pump coupling portion may be coaxial. The pump coupling portion may have a smaller outer diameter than the motor coupling portion, the main bearing portion, and the sub bearing portion. The pump assembly may include pump housings that have a pumping space that receives an oil pump. An end shaft support portion may be defined abutted to the pumping space inside the pump housings. An oil that is received into the end shaft support portion may be supplied to a first portion that is opposite to the end shaft support portion through the oil supply path of the rotary shaft. The compression portion may include a back pressure chamber that has a pressure lower than the oil supply path. The oil may be supplied to the first portion based on (i) a differential pressure between the oil supply path and the back pressure chamber and (ii) a pumping pressure of the pump assembly To achieve these objects and other advantages and in accordance with the purpose of the present disclosure, as embodied and broadly described herein, a compressor according to the present disclosure can comprise a case; a driving motor including a stator provided at an inner side of the case and a rotor rotatably provided at an inner side in a radius direction of the stator; a centrifugation space defined inside the case by a downstream side of the driving motor and the case, enabling centrifugation of a compressed refrigerant and a lubricant oil; a discharge pipe provided in the case, discharging the refrigerant inside the centrifugation space to the outside of the case; a rotary shaft rotated by being coupled to the rotor and provided with an oil supply path; a compression portion provided at an upstream side of the driving motor, compressing the refrigerant through rotation of the rotary shaft; a pump assembly provided below the rotary shaft, pumping oil by being rotated in a single body with the rotary shaft; and an oil pickup forming an oil supply path between the pump assembly and a low oil space formed inside the case.

The compression portion can include a muffler accommodating the compressed refrigerant discharged from the compression portion, provided to guide the compressed refrigerant to the discharge pipe.

The compression portion can include a fixed scroll and an orbiting scroll provided to compress the refrigerant through orbiting movement with respect to the fixed scroll.

A shaft support portion in which the rotary shaft is accommodated by passing therethrough can be provided at a center of the fixed scroll, and can include a first boss protruded toward the low oil space.

In some implementations, a pump holder portion recessed toward the driving motor to allow the pump assembly to be arranged therein is formed at a center of the muffler.

A shaft support portion in which the rotary shaft is accommodated by passing therethrough can be provided at a center of the pump holder portion, and can include a second boss protruded toward the driving motor.

In some implementations, at least a portion of the first boss is inserted into the second boss, and therefore the first boss and the second boss are overlapped with each other.

The pump assembly can include an oil pump connected to the rotary shaft and pump housings accommodating the oil pump.

The pump housings can include an upper housing inserted into the pump holder portion of the muffler and a lower housing coupled with the upper housing.

The upper housing can be provided with a shaft support portion in which the rotary shaft is accommodated by passing therethrough, and can include a third boss protruded toward the driving motor.

In some implementations, at least a portion of the third boss is inserted into the first boss, and therefore the first boss and the third boss are overlapped with each other.

In some implementations, the lower housing is provided with an end shaft support portion into which an end of the rotary shaft is inserted and supported.

In some implementations, a pumping space in which the oil pump is arranged is formed between the shaft support portion of the upper housing and the end shaft support portion of the lower housing, and the lower housing is provided with a communication portion for communicating the pumping space with the low oil space.

The communication portion can include a pickup arrangement groove into which the oil pickup is inserted and arranged.

The rotary shaft can include a motor coupling portion coupled with the driving motor; a main bearing portion extended from the motor coupling portion; an eccentric portion extended from the main bearing portion and coupled with the orbiting scroll; a sub bearing portion extended from the eccentric portion; and a pump coupling portion extended from the sub bearing portion and coupled with the pump assembly.

In some implementations, the rotary shaft is formed in a single body with one bar by mechanical processing of one bar.

In some implementations, the motor coupling portion, the main bearing portion, the sub bearing portion and the pump coupling portion have the same shaft, and the pump coupling portion has the smallest outer diameter.

Features of the aforementioned embodiments are complexly applicable to the other embodiments unless contradicted or exclusive.

In accordance with one embodiment of the present disclosure, a compressor, which enables effective and active oil supply even in a low pressure ratio driving area that is lack of a pressure difference, can be provided.

In accordance with one embodiment of the present disclosure, a compressor, in which a pump assembly for oil supply can be provided to be exactly matched with a center and its center can stably be fixed, can be provided.

It is understood that both the foregoing general description and the following detailed description of the present disclosure are exemplary and explanatory and are intended to provide further explanation of the present disclosure as claimed.

DETAILED DESCRIPTION

Particular implementations of the present disclosure are illustrated herein with reference to the accompanying drawings. Wherever possible, same reference numbers will be used throughout the drawings to refer to the same or like parts.

Figure 1:
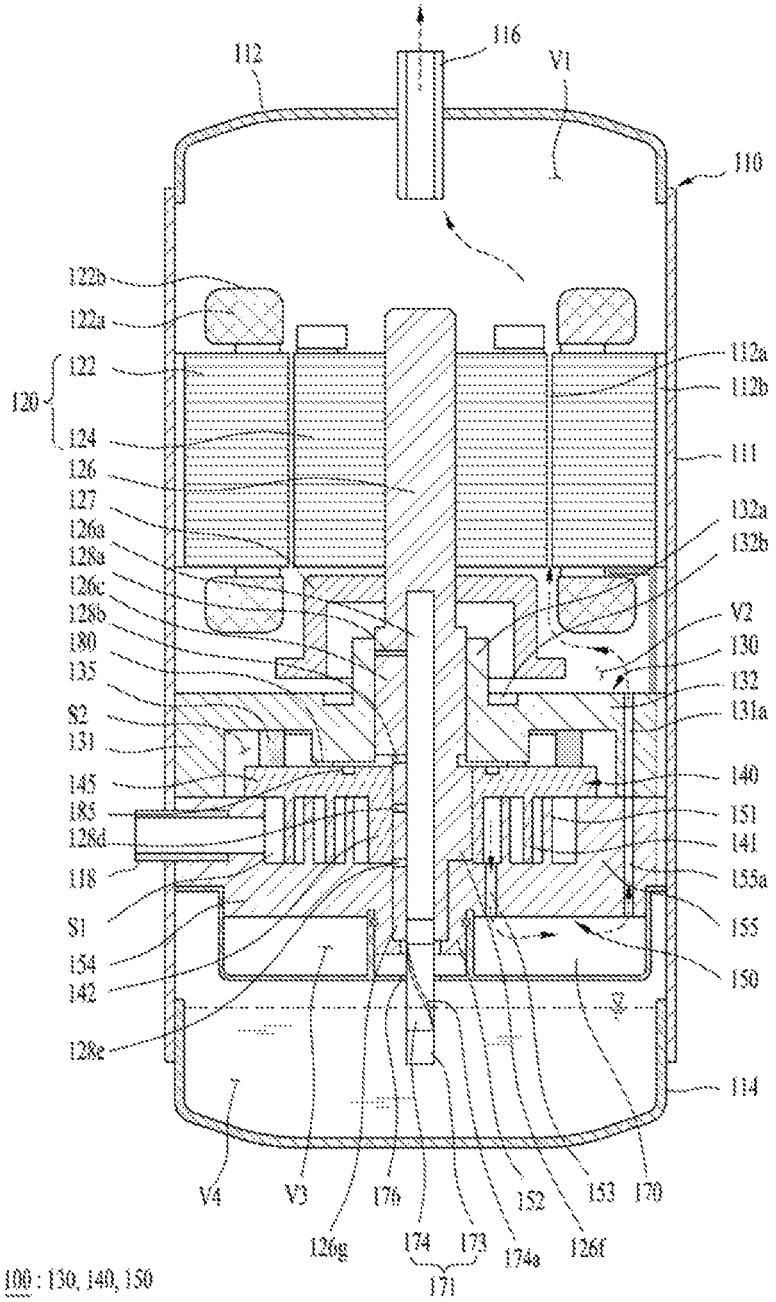
FIG. 1 is a cross sectional view of an example compressor.

Referring to FIG. 1, an example compressor is described in accordance with implementations of the present disclosure.

FIG. 1 is a cross sectional view of an example scroll compressor. Since a compression portion is located below a driving motor, the compressor can be referred to as a lower compression type compressor or an upstream compressor.

For convenience of description, upper and lower positions are determined based on a compressor located vertically. Upstream position or downstream position are determined based on a flow of a refrigerant and a position of a driving motor. In the compressor, an upper position can correspond to a downstream position, and a lower position can correspond to an upstream position.

In some implementations, the compressor can include a case 110, a driving motor 120, a compression portion 100, and a rotary shaft 126.

The case 110 can define an inner space. For example, a low oil space where an oil is stored can be provided below the case 110. The low oil space can correspond to a fourth space V4 which will be described later. That is, the fourth space V4 can be defined as the low oil space.

A refrigerant discharge pipe 116 for discharging the compressed refrigerant can be provided at the upstream.

For example, the inner space of the case 110 can include a first space V1 arranged at the upstream of the driving motor 120, a second space V2 arranged between the driving motor 120 and the compression portion 100, a third space V3 partitioned by a discharge cover 170, which will be described later, and the fourth space V4 arranged below the compression portion 100.

The first space V1 can provide a space where centrifugation of the compressed refrigerant and lubricant oil is performed. That is, the refrigerant can substantially be discharged to the discharge pipe 116 through centrifugation between the refrigerant and oil before the compressed refrigerant is discharged to the outside of the compressor through the discharge pipe 116. This centrifugation space V1 within the case 110 can be defined by a downstream side of the driving motor and the case 110.

The case 110 can have a cylindrical shape. For example, the case 110 can include a cylindrical shell 111 of which upper and lower ends are opened.

An upper shell 112 can be provided at an upper portion of the cylindrical shell 111, and a lower shell 114 can be provided at a lower portion of the cylindrical shell 111. For example, the upper and lower shells 112 and 114 can be coupled to the cylindrical shell 111 by welding, thereby defining an inner space.

The upper shell 112 can be provided with the refrigerant discharge pipe 116. The refrigerant compressed by the compression portion 100 can be discharged to the outside through the refrigerant discharge pipe 116. For example, the refrigerant compressed by the compression portion 100 can be discharged to the outside through the refrigerant discharge pipe 116 after passing through the third space V3, the second space V2 and the first space V1 in order.

An oil separator or oil returning unit that is typically connected with the compressor is not shown in FIG. 1. This means that the compressor according to implementations of the present disclosure can effectively separate an oil without a separate oil separator.

The lower shell 114 can partition the fourth space V4 that is a low oil space where an oil can be stored. The fourth space V4 can be used as an oil chamber for supplying an oil to the compression portion 100 such that the compressor can actively operate.

Also, a refrigerant suction pipe 118 provides a passage for receiving the refrigerant that will be compressed. The refrigerant suction pipe 118 can be disposed at a side of the cylindrical shell 111. The refrigerant suction pipe 118 can be provided to pass through a compression chamber S1 along a side of a fixed scroll 150 as described later.

The driving motor 120 can be provided at an inner side of the case 110. For example, the driving motor 120 can be arranged above the compression portion 100 at the inner side of the case 110.

The driving motor 120 can include a stator 122 and a rotor 124. The stator 122 can have a cylindrical shape, for example, and can be fixed to the case 110. A coil 122*a* can be wound in the stator 122. Also, a refrigerant path groove 112*a* can be defined between an outer circumferential surface of the rotor 124 and an inner circumferential surface of the stator 122 to allow the refrigerant or oil discharged from the compression portion 100 to pass therethrough. In some implementations, the refrigerant path groove 112*a* can be partitioned by the inner circumferential surface of the stator 122 and the outer circumferential surface of the rotor 124.

The rotor 124 can be inwardly disposed in a radius direction of the stator 122, and can generate a rotation power. In some implementations, the rotary shaft 126 can be fitted into the center of the rotor 124 such that the rotor 124 can be rotated together with the rotary shaft 126. The rotation power generated by the rotor 124 can be transferred to the compression portion 100 through the rotary shaft 126.

The compression portion 100 can be coupled to the driving motor 120 to compress the refrigerant. The compression portion 100 can be provided to allow the rotary shaft 126 connected to the driving motor 120 to pass therethrough.

The compression portion 100 can include a shaft support portion protruded upwardly and downwardly. The rotary shaft 126 can pass through at least a portion of the shaft support portion. For example, the shaft support portion can include a first shaft support portion upwardly protruded from the compression portion 100 and a second shaft support portion downwardly protruded from the compression portion 100, which are described herein in more detail.

In some implementations, the compression portion 110 includes a main frame 130, a fixed scroll 150 and an orbiting scroll 140.

For example, the compression portion 110 can further include an Oldham's ring 135. The Oldham's ring 135 can be provided between the orbiting scroll 140 and the main frame 130. Also, the Oldham's ring 135 can enable orbiting movement of the orbiting scroll 140 on the fixed scroll 150 while preventing rotation of the orbiting scroll 140.

The main frame 130 can be disposed below the driving motor 120, and form the upper portion of the compression portion 100.

The main frame 130 can include a frame end plate 132 (hereinafter, referred to as "first end plate") that generally has a circle shape, a frame shaft support 132*a* (hereinafter, referred to as "first shaft support portion") that is disposed at the center of the first end plate 132 and receives the rotary shaft 126 therethrough, and a frame sidewall 131 (hereinafter, referred to as "first sidewall) that downwardly protrudes from an outer circumference of the first end plate 132.

An outer circumference of the first sidewall 131 can adjoin the inner circumferential surface of the cylindrical shell 111, and its lower end can adjoin an upper end of a fixed scroll sidewall 155, which is described herein in more detail.

The first sidewall 131 can include a frame discharge hole 131*a* constituting a refrigerant passage by passing through the inside of the first sidewall 131 in a shaft direction. An inlet of the frame discharge hole 131*a* can fluidly communicate with an outlet of a fixed scroll discharge hole 155*a*, which is described herein in more detail. An outlet of the frame discharge hole 131*a* can fluidly communicate with the second space V2. The frame discharge hole 131*a* and the fixed scroll discharge hole 155*a*, which fluidly communicate with each other, can be referred to as second discharge holes 131*a* and 155*a*.

The frame discharge hole 131*a* can be provided in a plural number along the circumference of the main frame 130. The fixed scroll discharge hole 155*a* can be provided in a plural number along the circumference of the fixed scroll 150 to correspond to the frame discharge hole 131*a*.

The first shaft support portion 132*a* can protrude from an upper surface of the first end plate 132 to the driving motor 120. Also, the first shaft support portion 132*a* can be provided with a first bearing that receives and supports a main bearing portion 126*c* of the rotary shaft 126.

For example, the first shaft support portion 132*a* can rotatably receive and support the main bearing portion 126*c* of the rotary shaft 126, which constitutes the first shaft support portion. The first shaft support portion 132*a* can be provided at the center of the main frame 130 in a shaft direction to pass through the main frame 130.

An oil pocket 132*b* can collect an oil that is discharged between the first shaft support portion 132*a* and the rotary shaft 126. The oil pocket 132*b* can be defined at the upper surface of the first end plate 132.

The oil pocket 132*b* can be recessed at the upper surface of the first end plate 132. The oil pocket 132*b* can be defined in a ring shape along the circumference of the first shaft support portion 132*a*. Also, a back pressure chamber S2 can be defined at the bottom of the main frame 130 to support the orbiting scroll 140 by means of a pressure of a space defined by the fixed scroll 150 and the orbiting scroll 140.

For example, the back pressure chamber S2 can include an intermediate pressure area (that is, intermediate pressure chamber). An oil supply path 126*a* that is provided in the rotary shaft 126 can include a high pressure area having a pressure higher than that of the back pressure chamber S2. Therefore, an oil can be supplied to each target component through the oil supply path due to a pressure difference between the back pressure chamber and the oil supply path. In some instances, however, such oil supply does not occur as intended because the pressure difference is not sufficient in a low load driving area having low differential pressure. Particular implementations of the present disclosure are described herein that solve this problem.

In order to partition the high pressure area from the intermediate pressure area, a back pressure seal 180 can be provided between the main frame 130 and the orbiting scroll 140, and can serve as a sealing member, for example.

Also, the main frame 130 can be coupled with the fixed scroll 150 to define a space where the orbiting scroll 140 can pivotally be provided.

The fixed scroll 150 can be provided below the main frame 130. For example, the fixed scroll 150 constituting a first scroll can be coupled to the bottom of the main frame 130.

The fixed scroll 150 can include a fixed scroll end plate 132 (hereinafter, referred to as "second end plate") that generally has a circular shape, a fixed scroll sidewall 155 (hereinafter, referred to as "second sidewall") that protrudes from an outer circumference of the second end plate 154 to an upper portion of the second end plate 154, a fixed wrap 151 that protrudes from the upper surface of the second end plate 154 and is engaged with an orbiting wrap 141 of the orbiting scroll 140 to define a compression chamber S1, and a shaft support portion 152 of the fixed scroll 150 (hereinafter, referred to as "second shaft support portion") that is provided at the center of a rear surface of the second end plate 154 to allow the rotary shaft 126 to pass therethrough.

The compression portion 100 can include a first discharge hole 153 for discharging the compressed refrigerant to the discharge cover 170, and the aforementioned second discharge holes 131*a* and 155*a* that are spaced apart from the first discharge hole 153 outside a radius direction of the compression portion 100 and configured to guide the compressed refrigerant toward the refrigerant discharge pipe 116.

For example, the second end plate 154 can be provided with the first discharge hole 153 that id defined to guide the compressed refrigerant from the compression chamber S1 to an inner space of the discharge cover 170. Also, a position of the first discharge hole 153 can optionally be set in consideration of a discharge pressure which is required.

As the first discharge hole 153 is provided toward the lower shell 114, the discharge cover 170 can be coupled to the bottom of the fixed scroll 150 and guide the refrigerant that is discharged from the compression portion to the fixed scroll discharge hole 155*a*, which is described herein in more detail.

The discharge cover 170 can be sealed in and coupled to the lower end of the compression portion 100. The discharge cover 170 can guide the refrigerant compressed by the compression portion 100 toward the refrigerant discharge pipe 116.

For example, the discharge cover 170 can be sealed in and coupled to the bottom of the fixed scroll 150 to separate the discharge path of the refrigerant from the fourth space V4.

Also, the discharge cover 170 can be provided with a through hole 176 that is coupled to a sub bearing portion 126*g* of the rotary shaft 126, which constitutes a second bearing portion. The through hole 176 can allow an oil feeder 171 to pass therethrough. At least a portion of the oil feeder 171 can be immersed in the oil stored in the fourth space V4 of the case 110.

In some implementations, the second sidewall 155 can be provided with the fixed scroll discharge hole 155*a* constituting the refrigerant passage together with the frame discharge hole 131*a* by passing through the inside of the second sidewall 155 in a shaft direction.

The fixed scroll discharge hole 155*a* can correspond to the frame discharge hole 131*a*, and its inlet can fluidly communicate with the inner space of the discharge cover 170 and its outlet can fluidly communicate with an inlet of the frame discharge hole 131*a*.

The fixed scroll discharge hole 155*a* and the frame discharge hole 131*a* can communicate the third space V3 with the second space V2 such that the refrigerant discharged from the compression chamber S1 to the inner space of the discharge cover 170 can be guided to the second space V2.

A refrigerant suction pipe 118 can fluidly communicate with a suction side of the compression chamber S1 at the second sidewall 155. Also, the refrigerant suction pipe 118 can be spaced apart from the fixed scroll discharge hole 155*a*.

The second shaft support portion 152 can protrude from the lower surface of the second end plate 154 to the fourth space V4. Also, the second shaft support portion 152 can be provided with a second bearing such that a sub bearing 126*g* of the rotary shaft 126 can be inserted into and supported in the second bearing.

The second shaft support portion 152 can be bent toward a shaft center such that its lower end can constitute a thrust bearing by supporting a lower end of the sub bearing portion 126*g* of the rotary shaft 126.

The orbiting scroll 140 can be arranged between the main frame 130 and the fixed scroll 150 and provide a second scroll.

For example, the orbiting scroll 140 can perform orbiting movement by being coupled to the rotary shaft 126 and define a pair of compression chambers S1 with the fixed scroll 150. That is, the compression chambers S1 can be defined between the orbiting scroll 140 and the fixed scroll 150.

The orbiting scroll 140 can include an orbiting scroll end plate (hereinafter, referred to as "third end plate") that generally has a circular shape, an orbiting wrap 141 that protrudes from a lower surface of the third end plate 145 and is engaged with the fixed wrap 151, and a rotary shaft coupling portion 142 that is provided at the center of the third end plate 145 and rotatably coupled to an eccentric portion 126*f* of the rotary shaft 126.

An outer circumference of the third end plate 145 can be located at an upper end of the second sidewall 155, and a lower end of the orbiting wrap 141 can be tightly adhered to the upper surface of the second end plate 154 and therefore supported in the fixed scroll 150.

For example, a pocket groove 185 can be defined on the upper surface of the orbiting scroll 140 and configured for guiding oil discharged through oil holes 128*a*, 128*b*, 128*d*, and 128*e*, which will be described later.

For example, the pocket groove 185 can be recessed on the third end plate 145. That is, the pocket groove 185 can be defined on the third end plate 145 between the back pressure seal 180 and the rotary shaft 126.

Also, one or more pocket grooves 185 can be defined at both sides of the rotary shaft 126 as shown. The pocket groove 185 can have a ring shape on the third end plate 145 based on the rotary shaft 126 between the back pressure seal 180 and the rotary shaft 126.

The outer circumference of the rotary shaft coupling portion 142 is connected to the orbiting wrap 141 and serves to define the compression chamber S1 together with the fixed wrap 151 during a compression process.

The fixed wrap 151 and the orbiting wrap 141 can have an involute shape. The involute shape may mean a curved line corresponding to a track drawn by an end of a thread wound around a base source having a random radius when the thread is unwound.

Also, the eccentric portion 126*f* of the rotary shaft 126 can be inserted into the rotary shaft coupling portion 142. The eccentric portion 126*f* inserted into the rotary shaft coupling portion 142 can be overlapped with the orbiting wrap 141 or the fixed wrap 151 in a radius direction of the compressor.

In this case, the radius direction may mean a direction (that is, left and right direction) orthogonal to the shaft direction (that is, up and down direction).

As described above, if the eccentric portion 126*f* of the rotary shaft 126 is overlapped with the orbiting wrap 141 in a radius direction by passing through the third end plate 145, a repulsive force and a compressive force of the refrigerant can be given to the same plane based on the third end plate 145 and therefore counterbalanced with each other.

Also, the rotary shaft 126 can be coupled to the driving motor 120, and can include the oil supply path 126*a* for guiding the oil stored in the fourth space V4 that is a low oil space of the case 110, to the upper portion.

For example, an upper portion of the rotary shaft 126 can be fitted into the center of the rotor 124 such that its lower portion can be coupled to the compression portion 100 and therefore supported in a radius direction.

The rotary shaft 126 can transfer a rotary force of the driving motor 120 to the orbiting scroll 140 of the compression portion 100. As a result, the orbiting scroll 140 eccentrically coupled to the rotary shaft 126 can perform orbiting movement with respect to the fixed scroll 150.

The main bearing portion 126*c* can be provided below the rotary shaft 126 and therefore inserted into the first shaft support portion 132*a* of the main frame 130 and supported in a radius direction. Also, the sub bearing portion 126*g* can be provided below the main bearing portion 126*c* and therefore inserted into the second shaft support portion 152 of the fixed scroll 150 and supported in a radius direction. The eccentric portion 126*f* can be provided between the main bearing portion 126*c* and the sub bearing portion 126*g* and therefore inserted into and coupled to the rotary shaft coupling portion 142 of the orbiting scroll 140.

The main bearing portion 126*c* and the sub bearing portion 126*g* can be provided on the same shaft line to have the same shaft center, and the eccentric portion 126*f* can be provided to be eccentric with respect to the main bearing portion 126*c* or the sub bearing portion 126*g* in a radius direction.

The eccentric portion 126*f* can have an outer diameter smaller than that of the main bearing portion 126*c* and greater than that of the sub bearing portion 126*g*. In this case, the rotary shaft 126 can be coupled to the eccentric portion 126*f* by passing through each of the shaft support portions 132*a* and 152 and the rotary shaft coupling portion 142.

The oil supply path 126*a* can be defined inside the rotary shaft 126 and configured for supplying the oil in the fourth space V4 that is a low oil space to the outer circumference of each of the bearing portions 126*c* and 126*g* and the outer circumference of the eccentric portion 126*f* The oil holes 128*a*, 128*b*, 128*d* and 128*e* that are configured passing from the oil supply path 126*a* to the outside of a radius direction of the rotary shaft 126 can be defined at the bearing portions 126*c* and 126*g* and the eccentric portion 126*f* of the rotary shaft 126.

For example, the oil holes can include the first oil hole 128*a*, the second oil hole 128*b*, the third oil hole 128*d*, and the fourth oil hole 128*e*.

The first oil hole 128*a* can pass through the outer circumference of the main bearing portion 126*c*. The first oil hole 128*a* can pass from the oil supply path 126*a* to the outer circumference of the main bearing portion 126*c*.

Also, the first oil hole 128*a* can pass through, but not limited to, an upper portion of the outer circumferential surface of the main bearing portion 126*c*. In implementations where the first oil hole 128*a* includes a plurality of holes, each hole can be defined at the upper portion or the lower portion of the outer circumferential surface of the main bearing portion 126*c*, or can be defined at each of the upper portion and the lower portion of the outer circumferential surface of the main bearing portion 126*c*.

The second oil hole 128*b* can be defined between the main bearing portion 126*c* and the eccentric portion 126*f*. The second oil hole 128*b* can include a plurality of holes in some implementations.

The third oil hole 128*d* can pass through the outer circumferential surface of the eccentric portion 126*f*. For example, the third oil hole 128*d* can pass from the oil supply path 126*a* to the outer circumferential surface of the eccentric portion 126*f*.

The fourth oil hole 128*e* can be defined between the eccentric portion 126*f* and the sub bearing portion 126*g*.

The oil guided to the upper portion through the oil supply path 126*a* can be discharged through the first oil hole 128*a* and then supplied to the outer circumferential surface of the main bearing portion 126*c*.

Also, the oil guided to the upper portion through the oil supply path 126*a* can be discharged through the second oil hole 128*b* and then supplied to the upper surface of the orbiting scroll 140, and can be discharged through the third oil hole 128*d* and then supplied to the outer circumferential surface of the eccentric portion 126*f*.

Also, the oil guided to the upper portion through the oil supply path 126*a* can be discharged through the fourth oil hole 128*e* and then supplied to the outer circumferential surface of the sub bearing portion 126*g* or between the orbiting scroll 140 and the fixed scroll 150.

The oil feeder 171 for pumping the oil stored in the fourth space V4 can be coupled to the lower end of the rotary shaft 126, that is, the lower end of the sub bearing portion 126*g*. The oil feeder 171 can supply the oil stored in the fourth space V4 to the aforementioned oil holes 128*a*, 128*b*, 128*d* and 128*e*.

The oil feeder 171 can include an oil supply pipe 173 that is inserted into the oil supply path 126*a* of the rotary shaft 126 and coupled to the oil supply path 126*a*, and an oil suction member 174 that is inserted into the oil supply pipe 173 and configured to suction the oil.

The oil supply pipe 173 can be immersed in the fourth space V4 by passing through the through hole 176 of the discharge cover 170, and the oil suction member 174 can serve as a propeller.

The oil suction member 174 can define a spiral groove 174*a* that extends along a length direction of the oil suction member 174. The spiral groove 174*a* can be defined in the circumference of the oil suction member 174, and can be extended toward the aforementioned oil holes 128*a*, 128*b*, 128*d* and 128*e*.

When the oil feeder 171 is rotated together with the rotary shaft 126, the oil stored in the fourth space V4 can be guided to the oil holes 128*a*, 128*b*, 128*d* and 128*e* along the spiral groove 174*a*.

A balance weight 127 for restraining noise vibration can be coupled to the rotor 124 or the rotary shaft 126. The balance weight 127 can be provided in the second space V2 between the driving motor 120 and the compression portion 100.

An example process of operating the scroll compressor according to implementations of the present disclosure will be described hereinafter.

When a power source is applied to the driving motor 120 to generate a rotational force, the rotary shaft 126 coupled to the rotor 124 of the driving motor 120 is rotated. Then, while the orbiting scroll 140 that is eccentrically coupled to the rotary shaft 126 orbits with respect to the fixed scroll 150, the compression chamber S1 is defined between the orbiting wrap 141 and the fixed wrap 151. The compression chamber S1 can be defined in various steps with a volume narrower toward a center direction.

Then, the refrigerant supplied from the outside of the case 110 through the refrigerant suction pipe 118 can directly enter the compression chamber S1. This refrigerant can be compressed while moving toward a discharge chamber of the compression chamber S1 in accordance with orbiting movement of the orbiting scroll 140 and then discharged to the third space V3 through the first discharge hole 153 of the fixed scroll 150.

Afterwards, the compressed refrigerant discharged to the third space V3 has been discharged to the inner space of the case 110 through the fixed scroll discharge hole 155*a* and the frame discharge hole 131*a* and then discharged to the outside of the case 110 through the refrigerant discharge pipe 116. These operations can be repeated.

While the compressor is being driven, the oil stored in the fourth space V4 can be guided to the upper portion through the rotary shaft 126 and then actively supplied to the bearing portion, that is, bearing surface through the plurality of oil holes 128*a*, 128*b*, 128*d* and 128*e*, whereby the bearing portion can be prevented from being worn out.

Also, the oil discharged through the plurality of oil holes 128*a*, 128*b*, 128*d* and 128*e* can form an oil film between the fixed scroll 150 and the orbiting scroll 140 to maintain an airtight state in the compression portion.

For this reason, the oil can be mixed with the refrigerant compressed in the compression portion 100 and then discharged to the first discharge hole 153. Hereinafter, for convenience of description, the refrigerant mixed with the oil may be referred to as an oil mixture refrigerant.

The oil mixture refrigerant is guided to the first space V1 by passing through the second discharge holes 131*a* and 155*a*, the second space V2 and the refrigerant path groove 112*a*. The refrigerant of the oil mixture refrigerant guided to the first space V1 can be discharged to the outside of the compressor through the refrigerant discharge pipe 116 and the other oil can return to the fourth space V4 through an oil returning path 112*b*.

For example, the oil returning path 112*b* can be arranged at the outmost in a radius direction inside the case 110. For example, the oil returning path 112*b* can include a path between the outer circumferential surface of the stator 122 and the inner circumferential surface of the cylindrical shell 111, a path between the outer circumferential surface of the main frame 130 and the inner circumferential surface of the cylindrical shell 111, and a path between the outer circumferential surface of the fixed scroll 150 and the inner circumferential surface of the cylindrical shell 111.

In some implementations, since the discharge cover 170 is coupled to the lower end of the compression portion 100, a fine gap can exist between the lower end of the compression portion 100 and the upper end of the discharge cover 170. This fine gap may be a cause of refrigerant leakage.

That is, when the refrigerant is discharged to the third space V3 through the first discharge hole 153 of the compression portion 100 and then guided to the second discharge holes 131*a* and 155*a*, the refrigerant may leak out to the gap that may exist between the compression portion 100 and the discharge cover 170.

Also, leakage of the refrigerant may deteriorate compression efficiency of the compressor. This problem can be solved through sealing members provided between the compression portion 100 and the discharge cover 170 (a coupling portion of the compression portion 100 and the discharge cover 170) and a coupling structure of the compression portion 100 and the discharge cover 170.

The compressor according to implementations of the present disclosure has been described as above. Particularly, particular implementations of the scroll compressor has been described, which uses a differential pressure for supplying an oil.

Hereinafter, implementations of a compressor are described that include an oil pump for supplying an oil, along with the aforementioned oil supply structure based on the differential pressure.

In these implementations, the oil pump 230 (see FIG. 5) is provided using the discharge cover or the muffler 170 and the fixed scroll 150, which are shown in FIG. 1. That is, the oil pump 230 can additionally be arranged, and shapes of the rotary shaft 126, the muffler 170 and the fixed scroll 150 can be modified for arrangement of the oil pump 230. Also, an oil pickup 300 can be added for supplying the oil. The oil pickup can be the same as or similar to the oil feeder 171 that includes the oil supply pipe 173 or the oil suction member 174 shown in FIG. 1.

Figure 2:
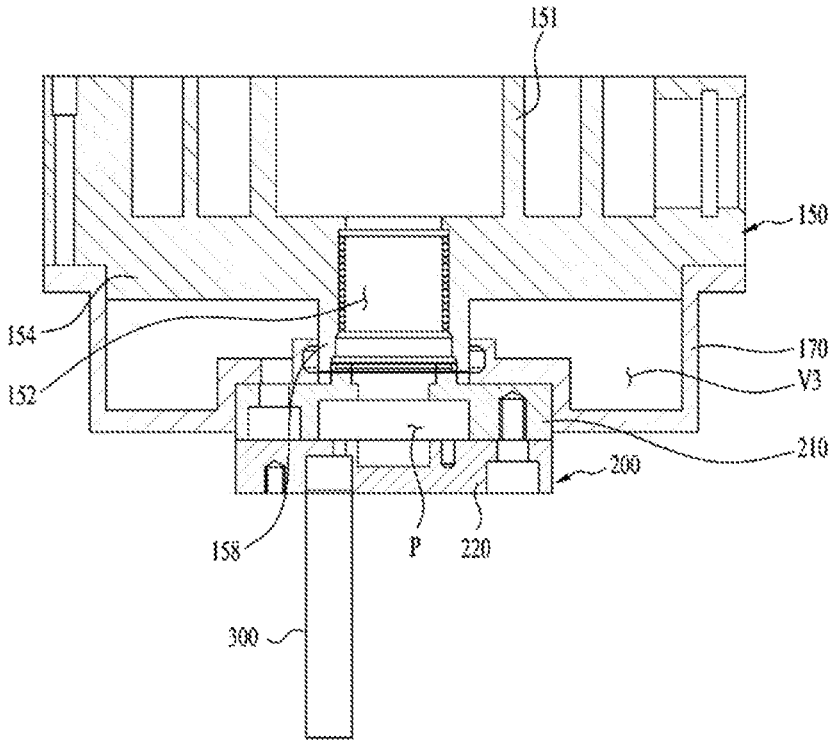
FIG. 2 is a cross sectional view of an example pump arrangement structure in the compressor.
Figure 3:
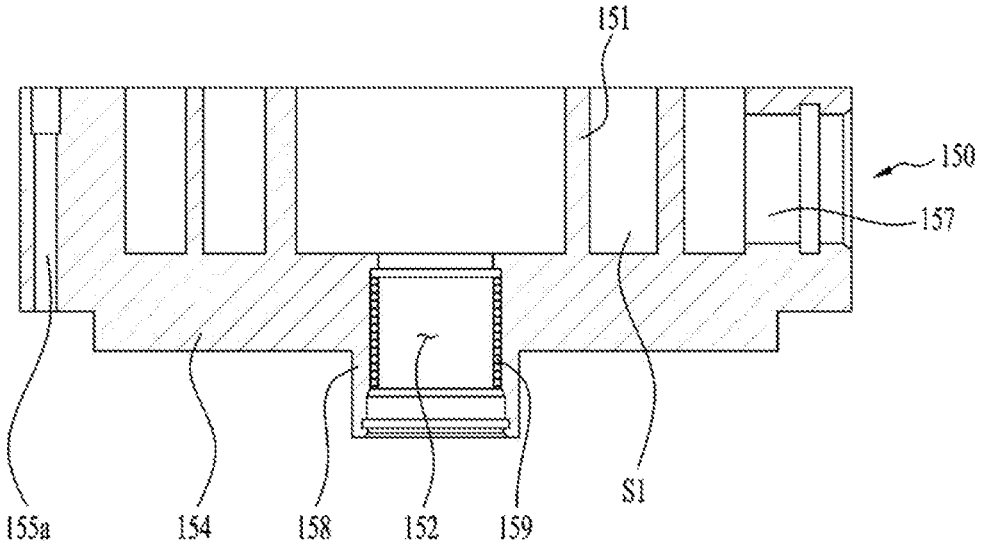
FIG. 3 is a cross sectional view of a fixed scroll shown in FIG. 2.
Figure 4:
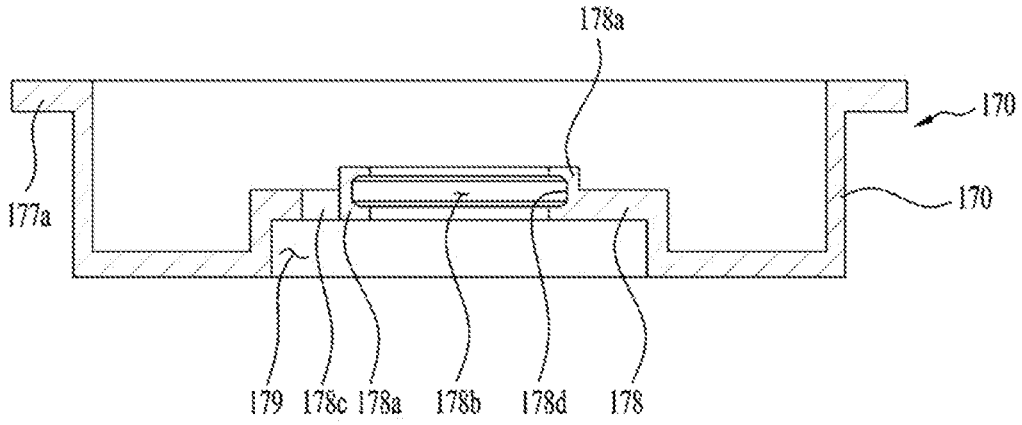
FIG. 4 is a cross sectional view of a muffler shown in FIG. 2.
Figure 5:
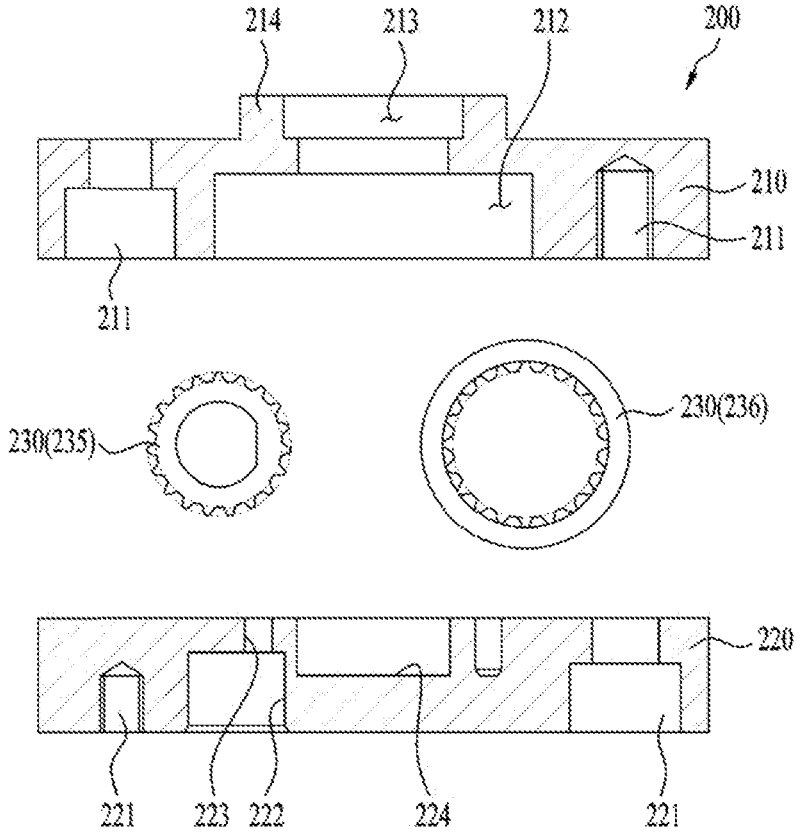
FIG. 5 is an exploded cross sectional view of a pump assembly shown in FIG. 2.

FIG. 2 illustrates a cross section of the fixed scroll 150, the muffler 170 and an pump assembly 200 that are coupled to one another. FIG. 3 illustrates a cross section of the fixed scroll 150 shown in FIG. 2, and FIG. 4 illustrates a cross section of the muffler 170 shown in FIG. 2. FIG. 5 illustrates an exploded cross section of the oil pump assembly 200 shown in FIG. 2.

The fixed scroll 150 and the muffler 170 can be coupled to each other by assembly. Both the fixed scroll 150 and the muffler 170 can be fixed with robustness by such assembly coupling. Particularly, based on the muffler 170, the muffler 170 and the fixed scroll 150 can be coupled to each other by assembly at the outside in a radius direction of the muffler 170.

In addition, the muffler 170 and the pump assembly 200 can be coupled to each other by assembly. The pump assembly 200 can include pump housings 210 and 220 forming an external appearance and accommodating the oil pump 230 therein. At least a portion of the pump housings 210 and 220 can be inserted into the muffler 170, whereby the pump housings 210 and 220 and the muffler 170 can be coupled to each other.

For example, the pump housings 210 and 220 can include an upper housing 210 and a lower housing 220, which can be coupled to each other. An inner space P can be defined by coupling of the pump housings 210 and 220, and can be a space for accommodating the oil pump and at the same time can be a temporary low oil space to which oil is supplied.

At least a portion of the upper housing 210 can be inserted into the muffler 170. Forward and backward movement and left and right movement of the pump housings 210 and 220 are restricted by such insertion coupling. The pump housings 210 and 220 can stably be fixed and coupled to the muffler by bolt or screw coupling. Rotation of the pump housings 210 and 220 is restricted by such bolt or screw coupling. The center of the muffler 170 can match (or be aligned with) the center of the pump assembly 220 by such a coupling structure, and such matching can stably be maintained.

Also, the fixed scroll 150 and the pump housings 210 and 220 can be coupled to each other by assembly. Some component of the pump housings 210 and 220 can be coupled to the fixed scroll 150 by being inserted into the fixed scroll 150. For example, the fixed scroll 150 and the pump housings 210 and 220 can be coupled to each other such that the center of the pump housings 210 and 220 can match (or be aligned with) the center of the fixed scroll 150.

Although not shown in FIG. 2, the rotary shaft 126 (see FIG. 1 and FIG. 6) that passes through the fixed scroll 150 up and down passes through the muffler 170 up and down and partially passes through the pump housings 210 and 220. That is, after the rotary shaft 126 passes through the fixed scroll 150, the muffler 170 and the upper housing 210 in order, the lower end of the rotary shaft 126, that is, the lower end is located inside the lower housing 220.

The lower portion of the rotary shaft 126 can be regarded as a driving shaft that drives the oil pump 230 as described later. Therefore, concentricity of the rotary shaft 126 can stably be maintained and at the same time rotation can be performed. For this reason, it is preferable that the fixed scroll 150, the muffler 170 and the upper housing 210 surround the rotary shaft 126.

In this case, the pump assembly 200 is provided at the lower end of the rotary shaft 126 and can pump oil by means of a driving force of the rotary shaft and at the same time rotatably support the rotary shaft.

An oil pickup 300 that defines an oil supply path can be provided between the low oil space V4 (see FIG. 1) and the pump assembly 200.

The coupling relation among the fixed scroll 150, the muffler 170 and the pink assembly 200 will be described in more detail.

The shaft support portion 152 that accommodates the rotary shaft 126 can be provided at the center of the fixed scroll 150, and can include a first boss 158 protruded toward the low oil space V4.

The first boss 158 can protrude from the second end plate 154 to the lower portion. Therefore, the fixed scroll 150 surrounds the rotary shaft 126 as much as a length obtained by adding a thickness of the second end plate 154 to a thickness of the first boss 158. That is, an area supporting the rotary shaft 126 is increased.

The first boss 158 can be provided in a hollow cylindrical shape, and a sub bearing can be provided inside the first boss 158 and the shaft support portion 152. That is, the sub bearing portion 126*g* of the rotary shaft 126 shown in FIG. 6 can rotatably be supported by the shaft support portion 152.

The muffler 170 can include a vessel shaped body 177, and the body 177 can have a cylindrical vessel shape of which diameter is greater than a height. A flange 177*a* for assembling with the fixed scroll 150 can be provided at the outside in a radius direction above the body 177 of the muffler 170, and the muffler 170 can be coupled to the fixed scroll 150 below the fixed scroll 150 through bolt or screw coupling to the flange 177*a*.

A pump holder portion 178 can be provided at the inner side in a radius direction of the muffler body 177. The pump holder portion 178 can have a shape uplifted from the center of the muffler body 177. In other words, a space 179 where the pump is arranged can be defined by the pump holder portion 178. This space 179 can be defined by the muffler body 177 of which center is recessed toward the driving motor 120.

Therefore, the pump holder portion 178 can define a cylindrical shaped recess space, and this recess space can define a space for pump arrangement.

A shaft support portion 178*b* of the pump holder portion 178 for allowing the rotary shaft 126 to pass therethrough up and down can be provided at the center of the pump holder portion 178, and can include a second boss 178*a* that protrudes toward the driving motor 120.

The second boss 178*a* can be provided in a hollow shape to accommodate the first boss 158 of the fixed scroll 150 therein. Therefore, the muffler 170 can be coupled to the fixed scroll 150 by assembly at the outside in a radius direction and coupled to the fixed scroll 150 by assembly at the inner side in a radius direction. Also, since the first boss 158 and the second boss 178*a* are overlapped with each other at a certain distance, their up and down or left and right movement can be restricted, whereby they can stably be coupled to each other.

An insertion depth of the first boss 158 is increased due to a protruded shape of the second boss 178*a*. That is, the insertion depth of the first boss becomes greater than the thickness of the pump holder portion 178.

An O-ring groove 178*d* can be defined at an inner side of the second boss 178*a*. The first boss 158 is inserted through an inner hollow hole of the second boss 178*a*. Therefore, leakage of oil or leakage of the compressed refrigerant, which is unwanted, may occur at the outside in a radius direction of the first boss 158. Therefore, this leakage can previously be avoided through O-ring.

The protruded shape of the second boss 178*a* can maintain concentricity among the muffler 170, the fixed scroll 150 and the rotary shaft 126 as well as secure the O-ring arrangement length and the insertion length of the first boss 158.

In some implementations, a plurality of coupling holes 178*c* can be defined in the pump holder portion 178. A coupling hole 211 can be defined even in the upper housing 210 of the pump assembly 200. The muffler 170 and the upper housing 210 can be coupled to each other through the coupling holes 178*c* and 211.

In other words, after the upper housing 210 is jointed to the pump holder portion 178, the lower housing 220 can be jointed to the upper housing 210. Therefore, the coupling holes 211 and 211 for bolt, rivet or screw coupling can be defined in the upper housing 210 and the lower housing 220. For this reason, a plurality of coupling holes for jointing the pump holder portion 178 and a plurality of coupling holes for arranging the lower housing 220 can be provided in the upper housing 210. These coupling holes can be spaced apart from each other along a circumferential direction.

A shaft support portion 213 of the upper housing 210 for allowing the rotary shaft 126 to pass therethrough can be provided in the upper housing 210 of the pump assembly 200, and can include a third boss 214 protruded toward the driving motor.

The third boss 214 can protrude from the upper surface of the upper housing 210 to the lower portion, and the protruded portion can be inserted into the first boss 158. That is, the third boss 214 can be assembled into the cylindrical hollow hole of the first boss 158. Therefore, as the first boss 158 and the third boss 214 are overlapped with each other at a certain distance, their coupling and concentricity can stably be maintained.

Finally, according to the implementations, the second boss 178*a* of the muffler 170, the first boss 158 of the fixed scroll 150 and the third boss 214 of the pump assembly 200 are located to be overlapped with one another from an outer side to an inner side in a radius direction. The rotary shaft 126 can pass through the center of these bosses and then be supported. Therefore, concentricity of the rotary shaft 126 and concentricity of these bosses can match (or be aligned with) each other and then stably be maintained.

A certain space is defined below the third boss 214 of the upper housing 210. The oil pump 230 is located in this space. This space can be referred to as a pumping space P (pumping space) or temporary low oil space 212.

The lower housing 220 can be coupled to the upper housing 210 at the lower portion of the upper housing 210. The pumping space P can substantially be sealed by this coupling.

An end shaft support portion 224 into which an end of the rotary shaft 126 is inserted and supported can be provided in the lower housing 220. Therefore, the end of the rotary shaft 126 is located in inner spaces of the pump housings 210 and 220 without being exposed to the low oil space V4. The end shaft support portion 224 surrounds the lower end of the rotary shaft 126. Therefore, the end shaft support portion 224 contributes to maintaining concentricity of the rotary shaft 126.

In some implementations, oil should be pumped into the pumping space P. The oil is located inside the low oil space V4. To this end, a communication portion 223 for communicating the pumping space P with the low oil space V4 is provided. The communication portion can be provided in the lower housing 220.

In some implementations, a component for solving an oil level difference between the pumping space P and the low oil space V4 is provided because the pumping space P is located to be higher than a normal oil level. To this end, the oil pickup 300 can be provided in the lower housing 220.

The oil pickup 300 can have a pipe shape, and can be inserted into the lower portion of the lower housing 220. To this end, an oil pickup arrangement groove 222 can be defined in the lower housing 220. The oil pickup arrangement groove 222 can fluidly communicate with the communication portion 223. Therefore, the oil entering through oil pickup 300 can enter the pumping space P by passing through the communication portion 223.

The oil pump 230 is a pump provided inside the aforementioned pumping space P, and can be embodied in various types. A trochoid pump is shown in FIG. 5 as an example. Instead of the trochoid pump, a gear pump can be provided.

The oil pump 230 can include an outer gear 236 and an inner gear 235. The inner gear 235 is inserted into a center portion of the outer gear 236 and then rotated. The inner gear 235 can be assembled into a pump coupling portion 126*h* which is a lower end of the rotary shaft 126. Therefore, the inner gear 235 can be rotated through rotation of the rotary shaft 126.

The inner gear 235 can eccentrically be rotated with respect to the outer gear 236. That is, the rotary shaft 126 and the inner gear 235 can be coupled to each other to have eccentricity. The number of teeth of the outer gear 236 can be more than the number of teeth of the inner gear 235 by 1 or more. As the inner gear 235 is eccentrically rotated, the oil is pumped from the outside of the oil pump 230, and the pumped oil can be discharged to the outside after entering the oil pump 230.

To this end, a hollow hole 126*a* to which the oil can be discharged can be defined in the rotary shaft 126, especially the pump coupling portion 126*h*. The hollow hole 126*a* can extend to the upper portion of the rotary shaft 126. In some implementations, the hollow hole 126*a* can more extend to an upper side of the main bearing portion 126*c* of the rotary shaft 126, referring to FIGS. 1 and 6. The hollow hole 126*a* passes through the rotary shaft 126 to supply oil to components such as bearing.

Figure 6:
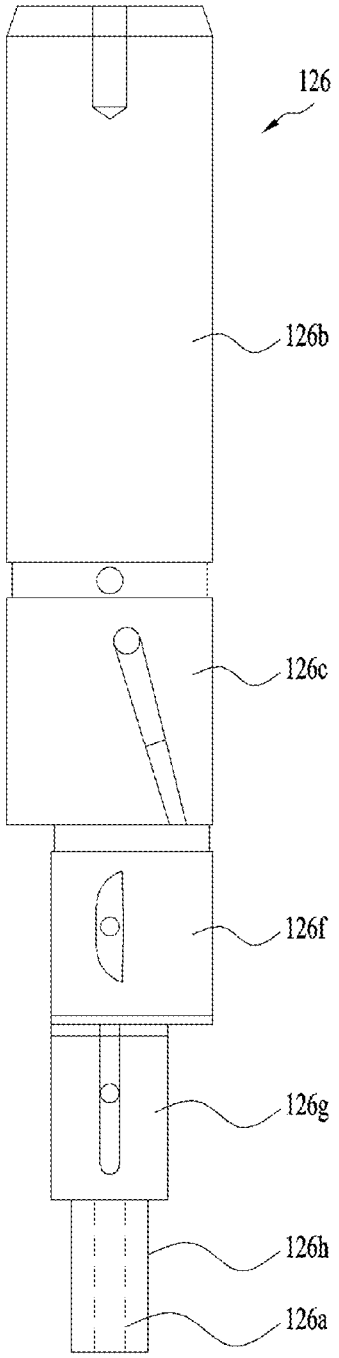
FIG. 6 illustrates an example rotary shaft in the compressor.

As shown in FIG. 6, the rotary shaft 126 can include a motor coupling portion 126*b*, a main bearing portion 126*c*, an eccentric portion 126*f*, a sub bearing portion 126*g* and a pump coupling portion 126*h*. In some implementations, the pump coupling portion 126*h* can additionally be provided, as compared with the implementations that the oil pump 230 is not provided.

In this case, the pump coupling portion 126*h* does not need to support a force greater than the other portion of the rotary shaft 126 and can have a relatively small diameter and height. Therefore, the pump coupling portion 126*h* imposes less effect on load and strength of the design of the rotary shaft 126. As a result, since the pump coupling portion 126*h* can simply be added to the rotary shaft 126, it can be easy to design and manufacture a new rotary shaft.

In some implementations, the end shaft support portion 224 provided in the pump housings 210 and 220 is located below the pumping space P. Therefore, the end shaft support portion 224 can be regarded as a space where oil is filled earlier than the pumping space P. In other words, if the pump is not driven, the oil is stored in the end shaft support portion 224.

The oil can continuously be supplied through the end shaft support portion 224. That is, this is because a hollow portion at a lower end of the pump coupling portion 126*h* provided in the end shaft support portion 224 starts from the end shaft support portion 224. Since oil pumping always starts from the space where oil is stored, continuous and stable oil supply can be performed.

The end shaft support portion 224 surrounds the lower end of the rotary shaft 126. Therefore, the end shaft support portion 224 contributes to maintaining concentricity of the rotary shaft 126.

According to the aforementioned implementations, in the compressor where a refrigerant is compressed at the upstream of the driving motor, it is possible to ensure reliability of oil supply in a driving area of low load/low pressure ratio while enlarging a driving area of the compressor. That is, a differential pressure can additionally be generated by driving of the oil pump in an area of low pressure ratio where a differential pressure source is insufficient. Also, concentricity of the oil pump and the rotary shaft can be maintained effectively and stably.

Further, according to these implementations, it is noted that oil can be supplied twice as much as oil supply based on a differential pressure. That is, the amount of oil supply can be increased.

However, when the amount of oil supply is increased, the amount of oil recovery can be reduced. However, as described above, since centrifugation can be performed at the upper side of the driving motor by the driving motor, the compressor where lower compression and upper centrifugation are performed enables effective oil separation and recovery.

It will be apparent to those skilled in the art that the present disclosure can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A compressor comprising: a case that defines an oil space; a driving motor that includes a stator disposed in the case and a rotor disposed in the stator, wherein the rotor is configured to rotate in the stator; a centrifugation space that is defined in the case by a first side of the driving motor and the case, and that is configured to permit centrifugation of a compressed refrigerant and a lubricant oil; a discharge pipe that is disposed at the case and configured to discharge the refrigerant from the centrifugation space to an exterior of the case; a rotary shaft that is coupled to the rotor and configured to rotate based on rotation of the rotor, wherein the rotary shaft defines a first oil supply path; a compression portion that is disposed at a second side of the driving motor that is opposite to the first side of the driving motor, wherein the compression portion is configured to compress the refrigerant based on rotation of the rotary shaft; a muffler that is configured to receive the compressed refrigerant that is discharged from the compression portion, wherein the compression portion being configured to guide the compressed refrigerant to the discharge pipe; a pump assembly that is configured to rotate with the rotary shaft and pump the oil based on the rotation of the pump assembly; and an oil pickup that defines a second oil supply path between the pump assembly and the oil space of the case, wherein the pump assembly includes: an oil pump that is connected to the rotary shaft, and pump housings that receive the oil pump, wherein a pump holder portion is defined at a center of the muffler and recessed toward the driving motor, and wherein the pump assembly is disposed in the pump holder portion, wherein the pump housing includes: an upper housing that is inserted into the pump holder portion of the muffler, and a lower housing that is coupled with the upper housing, and wherein the upper housing includes a shaft support portion of the upper housing that receives the rotary shaft through the shaft support portion of the upper housing; and a third boss that protrudes toward the driving motor.

2. The compressor of claim 1, wherein the compression portion further includes a fixed scroll and an orbiting scroll that is configured to orbit with respect to the fixed scroll and compress the refrigerant based on orbiting of the orbiting scroll with respect to the fixed scroll.

3. The compressor of claim 2, wherein the shaft support portion of the fixed scroll is disposed at a center of the fixed scroll and receives the rotary shaft through the shaft support portion of the fixed scroll, and wherein the shaft support portion of the fixed scroll includes a first boss that protrudes toward the oil space of the case.

4. The compressor of claim 3, wherein a shaft support portion of the pump holder portion is disposed at a center of the pump holder portion and receives the rotary shaft through the shaft support portion of the pump holder portion, and wherein the shaft support portion of the pump holder portion includes a second boss that protrudes toward the driving motor.

5. The compressor of claim 4, wherein at least a portion of the first boss is inserted into the second boss, and wherein the first boss and the second boss are at least partially overlapped with each other.

6. The compressor of claim 3, wherein at least a portion of the third boss is inserted into the first boss, and wherein the first boss and the third boss are at least partially overlapped with each other.

7. The compressor of claim 6, wherein the lower housing includes an end shaft support portion that receives and supports an end of the rotary shaft.

8. The compressor of claim 7, wherein a pumping space is defined between the shaft support portion of the upper housing and the end shaft support portion of the lower housing and receives the oil pump, and wherein the lower housing includes a communication portion that fluidly communicates the pumping space with the oil space.

9. The compressor of claim 8, wherein the communication portion includes a pickup arrangement groove that receives the oil pickup.

10. The compressor of claim 8, wherein the lower housing includes a plurality of coupling holes that are coupled with the upper housing.

11. The compressor of claim 2, wherein the rotary shaft includes:

a motor coupling portion that is coupled with the driving motor;

a main bearing portion that extends from the motor coupling portion;

an eccentric portion that extends from the main bearing portion and is coupled with the orbiting scroll;

a sub bearing portion that extends from the eccentric portion; and a pump coupling portion that extends from the sub bearing portion and is coupled with the pump assembly.

12. The compressor of claim 11, wherein the motor coupling portion, the main bearing portion, the sub bearing portion and the pump coupling portion are coaxial, and wherein the pump coupling portion has a smaller outer diameter than the motor coupling portion, the main bearing portion, and the sub bearing portion.

13. The compressor of claim 11, wherein the pump assembly includes pump housings that have a pumping space that receives the oil pump, and wherein an end shaft support portion is defined abutted to the pumping space inside the pump housings.

14. The compressor of claim 13, wherein an oil that is received into the end shaft support portion is supplied to an upper portion of the rotary shaft through the first oil supply path of the rotary shaft.

15. The compressor of claim 14, wherein the compression portion includes a back pressure chamber that has a pressure lower than the first oil supply path, and wherein the oil is supplied to the upper portion based on (i) a differential pressure between the first oil supply path and the back pressure chamber and (ii) a pumping pressure of the pump assembly.

* * * * *